US007333747B2

(12) United States Patent
Jones et al.

(10) Patent No.: US 7,333,747 B2
(45) **Date of Patent: *Feb. 19, 2008**

(54) TONER CARTRIDGE SEAL ASSEMBLY

(75) Inventors: James H. Jones, Fayetteville, NC (US); Charles Stanley Rice, Jr., Mauldin, SC (US); Donald R. Huck, Raleigh, NC (US); Randall William Hoskinson, Raleigh, NC (US)

(73) Assignee: Static Control Components, Inc., Sanford, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/707,578

(22) Filed: Feb. 16, 2007

(65) Prior Publication Data

US 2007/0140730 A1 Jun. 21, 2007

Related U.S. Application Data

(63) Continuation of application No. 11/076,479, filed on Mar. 9, 2005, now Pat. No. 7,197,260.

(51) Int. Cl.
*G03G 15/08* (2006.01)

(52) U.S. Cl. ..... 399/106; 399/109

(58) Field of Classification Search ..... 399/106, 399/109, 103; 222/DIG. 1
See application file for complete search history.

(56) References Cited

U.S. PATENT DOCUMENTS 4,981,218 A * 1/1991 Ban et al. ..... 222/DIG. 1
6,925,273 B1 * 8/2005 Michlin et al. ..... 399/106
7,197,260 B2 * 3/2007 Jones et al. ..... 399/106

* cited by examiner

*Primary Examiner*—Susan Lee

(57) ABSTRACT

A seal assembly for use in an imaging cartridge includes a gasket having first and second sides, a removable handle attached to an end of the gasket, a removable seal having a first side adhered to the first side of the gasket by an adhesive, a seal tail attached to an end of the removable seal, a release liner having a first side adhered to the second side of the gasket by an adhesive, and a release liner tail attached to an end of the release liner and adapted to be folded back over the release liner.

10 Claims, 3 Drawing Sheets

TONER CARTRIDGE SEAL ASSEMBLY

The present application is a continuation of U.S. patent application Ser. No. 11/076,479 filed on Mar. 9, 2005 now U.S. Pat. No. 7,197,260 which is incorporated by reference herein in its entirety.

BACKGROUND

The present invention generally relates to seals, gaskets and the like, and more particularly to a seal or gasket to retain or seal toner in a printer toner cartridge or the like.

In the imaging industry, there is a growing market for the remanufacture and refurbishing of various types of replaceable imaging cartridges such as toner cartridges, drum cartridges, inkjet cartridges, and the like. These imaging cartridges are used in imaging devices such as laser printers, xerographic copiers, inkjet printers, facsimile machines and the like, for example. Imaging cartridges, once spent, are unusable for their originally intended purpose. Without a refurbishing process these cartridges would simply be discarded, even though the cartridge itself may still have potential life. As a result, techniques have been developed specifically to address this issue. These processes may entail, for example, the disassembly of the various structures of the cartridge, replacing toner or ink, cleaning, adjusting or replacing any worn components and reassembling the imaging cartridge.

Imaging cartridges include one or more compartments holding the marking material which is deposited on a surface, such as paper. For a laser toner cartridge, this compartment is referred to as the toner hopper. During the remanufacture of a laser toner cartridge, any remaining residual toner should be removed from the toner hopper and the toner hopper should be cleaned. New toner is then placed in the toner hopper and the hopper opening is then sealed with a toner hopper seal. The purpose of the toner hopper seal is to ensure that toner does not migrate from the toner hopper during shipping of the toner cartridge package. Being a fine, dry powder, toner will migrate throughout the package and may damage other components of the toner cartridge. Such toner migration will also create an esthetically unpleasing mess for the end user. If the toner is not confined to the toner hopper, the end users may have toner on their hands and clothes.

Some types of toner cartridges, such as the HP 1320, for example, have a toner hopper opening which is not readily accessible due to the developer roller portion of the toner cartridge not being removable from the toner hopper. To seal such a toner hopper, the toner hopper seal must be inserted through slot, or sealing channel, in the side to the toner cartridge to place the seal over the toner hopper opening and between the toner hopper and the developer roller portion of the toner cartridge. In order to insert a seal into such a slot, an insertion tool may be used to force and guide the seal through the sealing channel between the toner hopper and the developer roller portion. It would be advantageous to provide a seal assembly which allows a seal to be inserted into the sealing channel without the need for a separate insertion tool.

SUMMARY

In one aspect of the present invention, a rigid insertion seal assembly for use in an imaging cartridge comprises a removable rigid insertion element having first and second sides. The seal assembly also includes a removable seal having a first side adhered to the first side of the removable rigid insertion element by a low tack adhesive, a second side coated with an adhesive layer, and a seal tail folded over a first end of the rigid insertion element and extending over at least a portion of the second side of the removable rigid insertion element. A release liner covers the adhesive layer and has a release liner tail.

In another aspect of the present invention, a seal assembly for use in an imaging cartridge includes a gasket having first and second sides, a removable handle attached to an end of the gasket, a removable seal having a first side adhered to the first side of the gasket by an adhesive, a seal tail attached to an end of the removable seal, a release liner having a first side adhered to the second side of the gasket by an adhesive, and a release liner tail attached to an end of the release liner and adapted to be folded back over the release liner.

A more complete understanding of the present invention, as well as further features and advantages of the invention, will be apparent from the following detailed description and the accompanying drawings.

DETAILED DESCRIPTION

The following detailed description of preferred embodiments refers to the accompanying drawings which illustrate specific embodiments of the invention. In the discussion that follows, specific systems and techniques for manufacturing or forming an insertable seal assembly for remanufacturing toner cartridges are disclosed. Other embodiments having different structures and operations for the manufacture of other types of seals or seal assemblies do not depart from the scope of the present invention.

Figure 1:
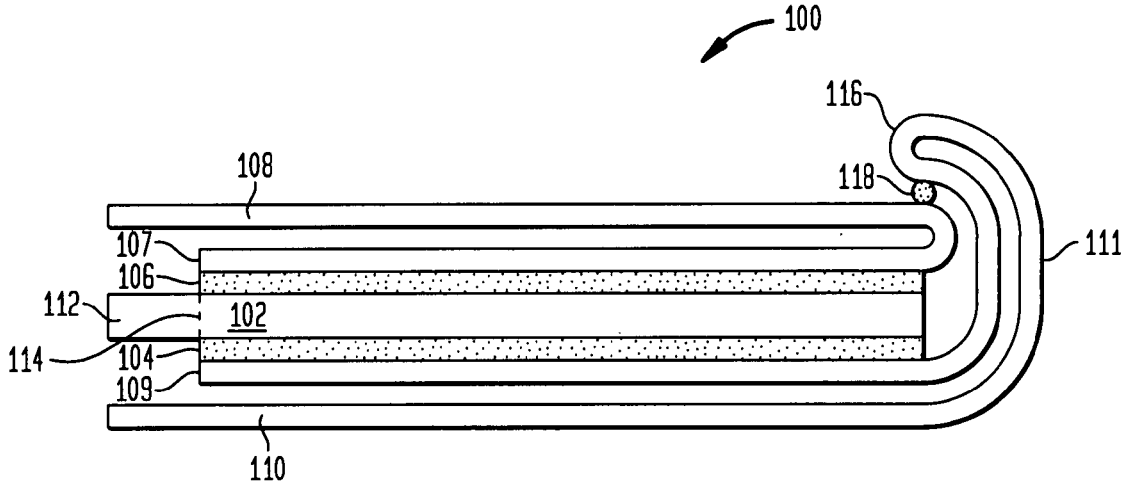
FIG. 1 shows a side view of a seal assembly in accordance with the present invention.

FIG. 1 shows a side view of a seal assembly 100 in accordance with the present invention. The seal assembly 100 is intended to be inserted into a slot or sealing channel on a side of a toner cartridge to seal the toner hopper opening prior to use of the toner cartridge. The seal assembly 100 comprises a gasket 102 coated with adhesive layers 104 and 106 on each side of the gasket 102. The gasket 102 may suitably comprise a rigid plastic, such as high impact polystyrene (HIPS), for example, or other materials of sufficient rigidity to allow for the insertion of the seal assembly 100 into the sealing channel. The gasket 102 is attached to a removable handle 112. In one aspect of the present invention, the handle 112 is integral with the gasket 102 and is formed from the same rigid material to allow a user to grasp the handle 112 and maneuver the seal assembly 100. Perforations 114 or other suitable elements may divide the handle 112 from the gasket 102 and allow the handle 112 to be separated from the gasket 102 after the seal assembly 100 has been properly installed.

Figure 3:
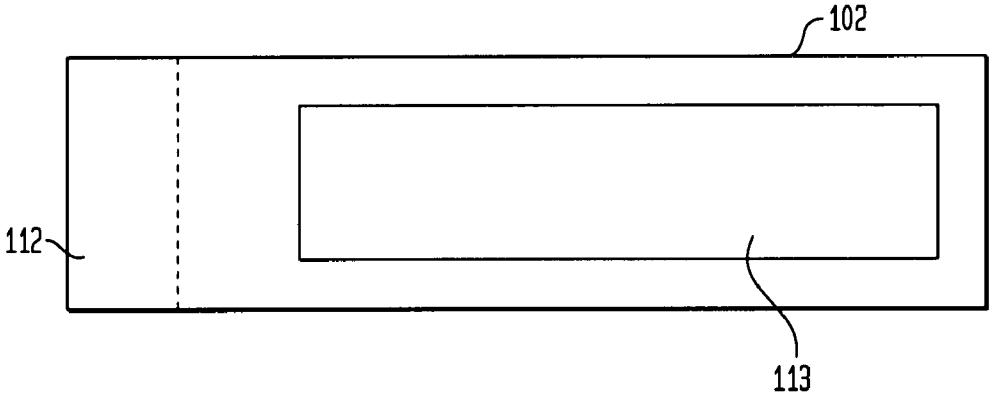
FIG. 3 shows a top view of a seal gasket suitable for used with the seal assembly of FIGS. 1 and 2 in accordance with the present invention.

As seen in FIG. 3, the gasket 102 includes a gasket opening 113 running down the length of the gasket 102. The size of the gasket opening 113 may conform generally to the size of the opening of the toner hopper to be sealed. A removable seal 107 covers the gasket opening 113 and is attached to one side of the gasket 102 by the adhesive layer 106. The removable seal 107 is attached to a seal tail 108 folded back over the removable seal 107. After the seal assembly 100 has been fully inserted into the sealing channel, an end portion of the seal tail 108 extends outward from the toner cartridge. Prior to installing the toner cartridge in a printer, a user pulls the seal tail 108 to remove the removable seal 107. The removable seal 107 may have a greater width than the seal tail 108. In such a case, a center portion of the removable seal 107 will be torn out of the seal assembly 100 when an end user pulls the seal tail 108. Alternately, the removable seal 106 and the seal tail 108 may share a common width. In such a case, the entire removable seal 106 will be separated from the seal assembly 100 when an end user pulls the seal tail 108.

The removable seal 107 may be integral with the seal tail 108. Alternately, the seal tail 108 may be a separate material attached to the removable seal 107. The removable seal 107 and the seal tail 108 may suitably comprise a synthetic material, such as polyester, polypropylene, a silicon film or a combination of these materials, for example.

To allow for the attachment of the seal assembly 100 to the toner hopper opening, the adhesive layer 104 preferably covers the bottom side of the gasket 102. The adhesive layer 104 may suitably comprise rubber, acrylic, a structural carrier, or a combination of such materials, for example. The adhesive layer 104 is covered by a release liner 109 to protect the adhesive layer 104 until the release liner 109 is removed prior to attachment of the seal assembly 100 to the toner hopper. The release liner 109 is attached to a release liner tail 110 folded back over the release liner 109.

Figure 2:
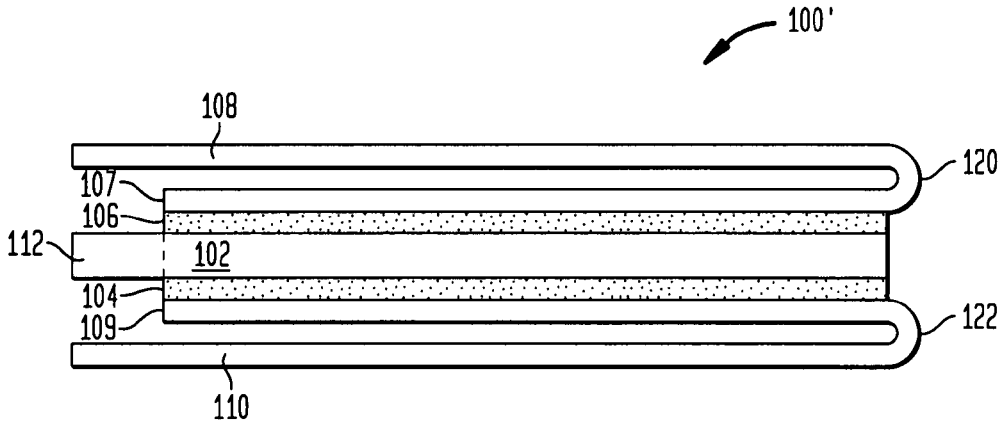
FIG. 2 shows a side view of an alternate embodiment of the seal assembly of FIG. 1 in accordance with the present invention.

To facilitate insertion of the seal assembly 100 into the sealing channel of the toner cartridge, a portion 111 of the release liner tail 110 may be wrapped around the end of the seal assembly 100 as shown in FIG. 1. The portion 111 may be creased at a fold 116 or held in place by an adhesive 118. Such an arrangement ensures that the removable seal 107 and the release liner 109 are not peeled away during the insertion of the seal assembly 100 into the sealing channel. In an alternate embodiment, the release liner tail 110 and the seal tail 108 may be creased at the end of the gasket 102. As seen in FIG. 2, a seal assembly 100' in accordance with the present invention includes the seal tail 108 creased at fold 120 and the release liner tail 110 creased at fold 122.

To install the seal assembly 100, a user holds the removable handle 112 and slides the seal assembly into the seal channel of the toner cartridge. The gasket 102 and the handle 112 provide sufficient rigidity to allow this insertion without the need for an insertion tool. After the seal assembly 100 has been fully inserted into the sealing channel, an end of the release liner tail 110 extends outward from the toner cartridge. The user then pulls on this end of the release liner tail 110 to remove the release liner 109 and expose the adhesive layer 104, thus adhering the seal assembly 100 over the toner hopper opening. Additional pressure can be applied to the gasket 102 to ensure the seal assembly 100 properly adheres. The removable handle 112 is then broken off and discarded. Prior to installing the toner cartridge in a printer, a user pulls the seal tail 108 to remove the removable seal 107 and allow toner to migrate from the toner hopper through the gasket opening 113.

Figure 4:
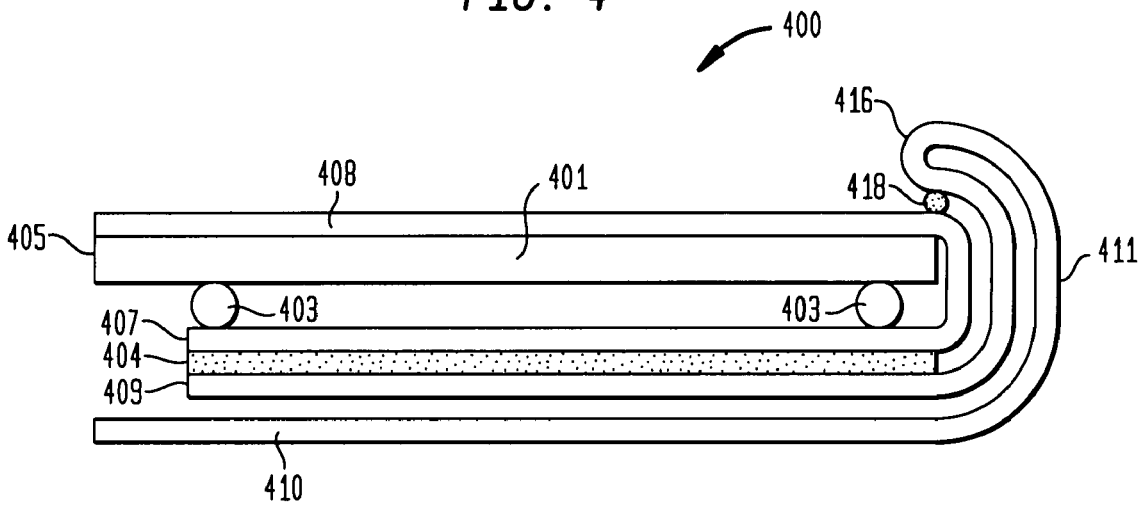
FIG. 4 shows a side view of a seal assembly in accordance with the present invention.

FIG. 4 shows a side view of a seal assembly 400 in accordance with another aspect of the present invention. The seal assembly 400 is intended to be inserted into a slot or sealing channel on a side of a toner cartridge to seal the toner hopper opening prior to use of the toner cartridge. The seal assembly 400 comprises a rigid insertion element 401 adhered to a removable seal 407 by adhesive elements 403. The adhesive elements 403 may suitably comprise a low tack adhesive, such as styrene isopropene styrene (SIS), for example. The low tack adhesive allows the rigid insertion element 410 to be separated from the seal assembly 400 after the adhesive layer 404 has adhered the removable seal 407 to a surface. The adhesive strength of the low tack adhesive should be much less than the adhesive strength of the adhesive layer 404. The rigid element 401 may suitably comprise a rigid plastic, such as high impact polystyrene (HIPS), for example, or other materials of sufficient rigidity to allow for the insertion of the seal assembly 400 into the sealing channel.

The removable seal 407 is attached to a seal tail 408 folded back over an end of the rigid insertion element 401. The removable seal 407 may be integral with the seal tail 408. Alternately, the seal tail 108 may be a separate material attached to the removable seal 407. The removable seal 407 and the seal tail 408 may suitably comprise a synthetic material, such as polyester, polypropylene or a silicon film, for example. An end portion of the rigid insertion element 401 not covered by the removable seal 407 forms a handle 405 which allows for the manipulation of the seal assembly 400.

To allow for the attachment of the seal assembly 400 to the toner hopper opening, an adhesive layer 404 preferably covers the side of the removable seal 407 opposite of the adhesive elements 403. The adhesive layer 404 may suitably comprise rubber, acrylic, a structural carrier, or a combination of such materials, for example. The adhesive layer 404 is covered by a release liner 409 to protect the adhesive layer 404 until the release liner 409 is removed prior to attachment of the seal assembly 400 to the toner hopper. The release liner 409 is attached to a release liner tail 410 folded back over the release liner 409.

Figure 5:
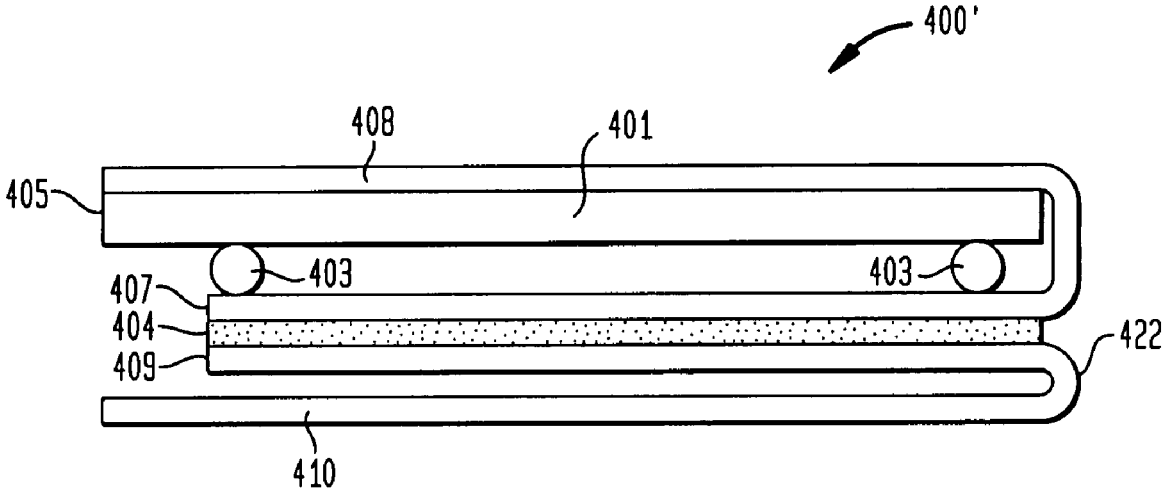
FIG. 5 shows a side view of an alternate embodiment of the seal assembly of FIG. 4 in accordance with the present invention.

To facilitate insertion of the seal assembly 400 into the sealing channel of the toner cartridge, a portion 411 of the release liner tail 410 may be wrapped around the end of the seal assembly 400 as shown in FIG. 4. The portion 411 may be creased at a fold 416 or held in place by an adhesive 418. Such an arrangement ensures that the removable seal 407 and the release liner 409 are not peeled away during the insertion of the seal assembly 400 into the sealing channel. In an alternate embodiment, the release liner tail 410 may be creased at the end of the seal assembly 400. As seen in FIG. 5, a seal assembly 400' in accordance with the present invention includes the release liner tail 410 creased at fold 422.

To install the seal assembly 400, a user slides the seal assembly 400 into the seal channel of the toner cartridge. The rigid insertion element 401 provides sufficient rigidity to allow this insertion without the need for an insertion tool. After the seal assembly 400 has been fully inserted into the sealing channel, an end of the release liner tail 410 extends outward from the toner cartridge. The user then pulls on this end of the release liner tail 410 to remove the release liner 409 and expose the adhesive layer 404, thus adhering the seal assembly 400 over the toner hopper opening. The handle 405 can also be used to force the rigid insertion element 401 to exert additional pressure on the adhesive 404 to ensure the seal assembly 400 properly adheres to the toner hopper opening. The rigid insertion element 401 is then pulled out of the sealing channel, thus breaking the rigid insertion element 401 away from the seal assembly 400 at the low tack adhesive elements 403. The low tack adhesive elements 403 have a sufficiently low securing force when compared to the adhesive layer 404 to allow the rigid insertion element 401 to be removed from the sealing channel, leaving the seal 407 secured over the toner hopper opening. Prior to installing the toner cartridge in a printer, a user pulls the seal tail 408 to remove the removable seal 407 and allow toner to migrate from the toner hopper.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A seal assembly for use in an imaging cartridge comprising:

a gasket having first and second sides;

a removable handle attached to an end of the gasket;

a removable seal having a first side adhered to the first side of the gasket by an adhesive;

a seal tail attached to an end of the removable seal;

a release liner having a first side adhered to the second side of the gasket by an adhesive; and a release liner tail attached to an end of the release liner and adapted to be folded back over the release liner.

2. The seal assembly of claim 1 wherein a portion of the release liner tail is wrapped around an end of the seal assembly opposite the removable handle.

3. The seal assembly of claim 2 wherein the portion is held in place by an adhesive.

4. The seal assembly of claim 1 wherein the adhesive adhering the first side of the release liner to the second side of the gasket is adapted for attaching the seal assembly over a toner hopper opening of the imaging cartridge.

5. The seal assembly of claim 1 wherein when the release liner tail is folded back over the release liner, an end of the release liner tail extends to an area near the removable handle.

6. A method of sealing an imaging cartridge comprising:

providing a seal assembly for use in an imaging cartridge comprising a gasket having first and second sides, the first side at least partially covered by a first adhesive and the second side at least partially covered by a second adhesive, a removable handle attached to an end of the gasket, a removable seal having a first side adhered to the first side of the gasket by the first adhesive, a seal tail attached to an end of the removable seal, a release liner having a first side adhered to the second side of the gasket by the second adhesive, and a release liner tail attached to an end of the release Liner and folded back over the release liner;

inserting the seal assembly into a sealing channel of an imaging cartridge such that an end of the release liner tail extends outward from the imaging cartridge;

pulling on the end of the release liner tail to remove the release liner from the seal assembly and expose the second adhesive; and adhering the second adhesive to a surface of the imaging cartridge.

7. The method of claim 6 wherein prior to the step of inserting, a portion of the release liner tail is wrapped around an end of the seal assembly.

8. The method of claim 7 wherein the portion is held in place by an adhesive.

9. The method of claim 6 wherein after the step of inserting, the end of the release liner tail is disposed near the removable handle.

10. The method of claim 6 further comprising:

removing the removable handle.

* * * * *